United States Patent [19]

Costigan

[11] Patent Number: 4,466,602

[45] Date of Patent: Aug. 21, 1984

[54] ADJUSTABLE MOTION CONTROL APPARATUS FOR FABRIC SPREADING MACHINES

[75] Inventor: Conrad A. Costigan, Richmond Hill, N.Y.

[73] Assignee: Spreading Machine Exchange, Inc., New York, N.Y.

[21] Appl. No.: 430,993

[22] Filed: Sep. 30, 1982

[51] Int. Cl.[3] ..... B65H 29/46

[52] U.S. Cl. ..... 270/31

[58] Field of Search ..... 270/30–31

[56] References Cited

U.S. PATENT DOCUMENTS

| | | | |
|---|---|---|---|
| 2,761,675 | 9/1956 | Obedin | 270/31 |
| 4,082,258 | 4/1978 | Smith | 270/31 |
| 4,285,506 | 8/1981 | Weaver et al. | 270/30 |

FOREIGN PATENT DOCUMENTS

| | | | |
|---|---|---|---|
| 2353547 | 10/1973 | Fed. Rep. of Germany | 270/31 |
| 2159047 | 6/1973 | France | 270/30 |

*Primary Examiner*—E. H. Eickholt

*Attorney, Agent, or Firm*—Edward F. Levy

[57] ABSTRACT

An adjustable motion control apparatus for fabric spreading machines includes a track which is attached to an edge of the table on which the fabric spreading machine deposits layers of fabric. A pair of blocks are slidably mounted on the track and a rail member is mounted on the pair of blocks. An end of the rail member includes a cam surface which actuates a switch on a carriage assembly of the fabric spreading machine to decrease the traverse speed of the carriage assembly. A cam block is mounted on the rail member and actuates a second switch on the carriage assembly which reverses the direction of traverse of the carriage assembly. When it is desired to adjust the motion of the carriage assembly to vary the length of the fabric being deposited, the operator need only loosen a pair of set screws on the blocks, slide the rail to a new position relative to the table and retighten the set screws.

10 Claims, 6 Drawing Figures

FIG. 2
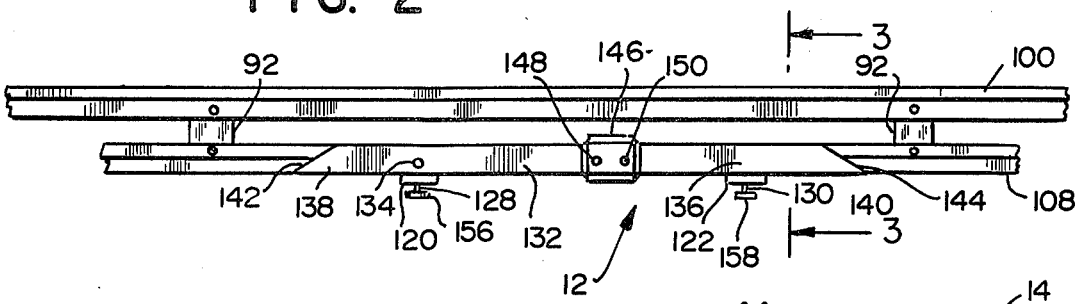
FIG. 3
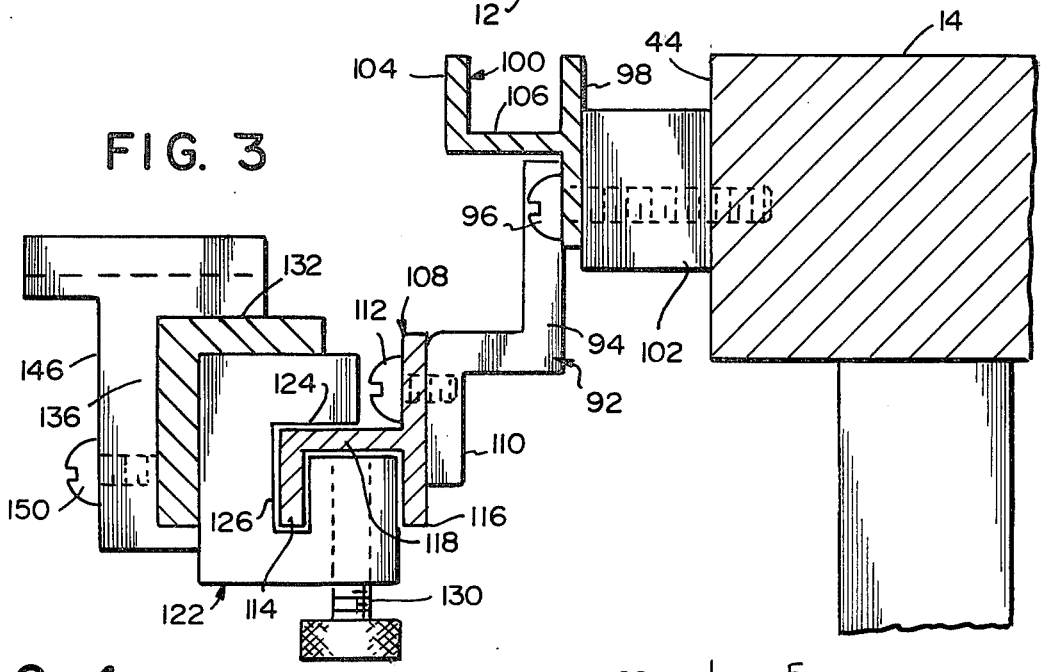
FIG. 4
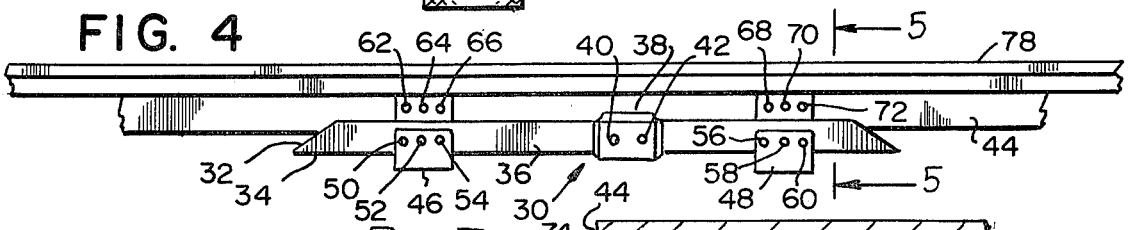
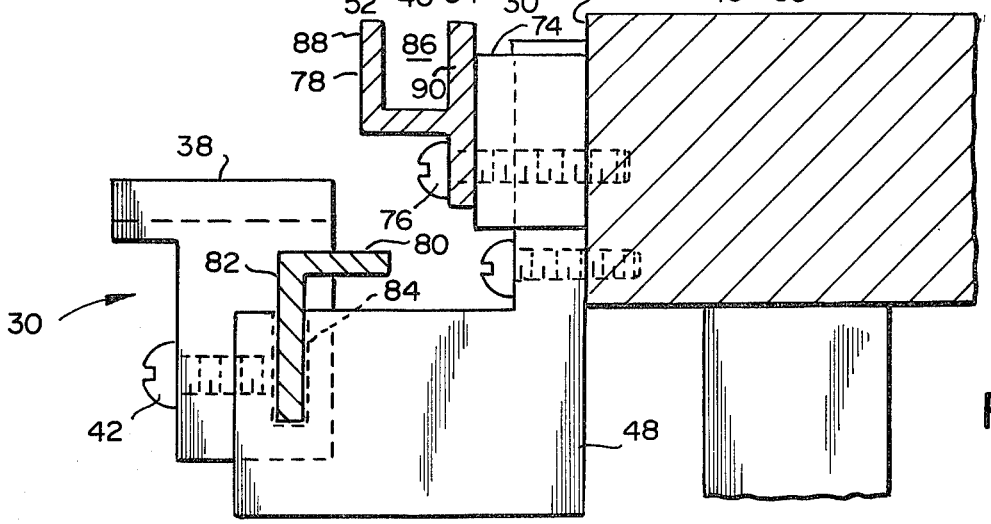
FIG. 5

ADJUSTABLE MOTION CONTROL APPARATUS FOR FABRIC SPREADING MACHINES

BACKGROUND OF THE INVENTION

Conventional fabric spreading machines include a removable carriage assembly which rides on a table and deposits layers of fabric or other sheet material on to the table from a supply roll which is mounted on the carriage assembly. In motor-driven automatic spreading machines, the motion of the carriage assembly is controlled by a pair of switches mounted on the carriage assembly. The first of these switches causes the carriage assembly to slow down when the switch comes into contact with the end of a rail which is mounted on the edge of the table by means a pair of brackets and a plurality of machine screws. The second switch causes the carriage assembly to reverse direction when the switch comes into contact with a cam block which is mounted on the rail.

In order to adjust the length of the fabric layers being deposited on the table, the position of the rail and the cam block must be adjusted relative to the table. This procedure requires an operator to unscrew the machine screws which attach the brackets to the table, re-position and re-attach the brackets to the table. The position of the cam block on the rail must then be adjusted by loosening set screws which hold the cam block in place. This procedure is both tedious and time consuming and results in an excessive amount of downtime whenever the fabric spreading machine is adjusted for a new run.

It is an object of the present invention to provide an adjustable motion control apparatus for a fabric spreading machine which can be rapidly and easily adjusted to vary the length of fabric being spread.

Another object of the present invention is to provide an adjustable motion control apparatus which can be easily mounted on the table supporting a fabric spreading machine without a need for major structural modifications of the fabric spreading machine or of the table.

Another object of the present invention is to provide an adjustable motion control apparatus for fabric spreading machines which can be adjusted without a need for special tools.

Still another object of the present invention is to provide an adjustable motion control apparatus for fabric spreading machines which comprises a limited number of relatively simple parts which are economical of manufacture.

SUMMARY OF THE INVENTION

In accordance with the present invention, there is provided an adjustable motion control apparatus for fabric spreading machines. The apparatus comprises a plurality of brackets which are attached to the table of the fabric spreading machine by means of a plurality of screws, one for each bracket, with the screws passing through a guide track which is part of the conventional fabric spreading machine and which guides the motion of the carriage assembly.

The brackets support an auxiliary track which, for economy of manufacture, has the same cross-sectional configuration as the guide track. A pair of slide blocks are slidably mounted on the auxiliary track, and the slide blocks may be locked in place in any position along the auxiliary track by means of a set screw mounted in each slide block. The slide blocks support a rail the ends of which have tapered cam surfaces. A cam block is slidably mounted on the rail and may be locked in place on the rail by means of a pair of set screws mounted on the cam block. When the first of a pair of switches, which are mounted on the carriage assembly of the fabric spreading machine, comes into contact with the tapered cam surface on the end of the rail, an electrical signal is sent to the control circuit of the carriage assembly causing the traverse speed of the carriage assembly to slow down. When the second switch comes into contact with the cam block, an electrical signal is sent to the control circuit of the carriage assembly causing the carriage assembly to reverse direction.

When it is desired to change the length of the fabric being spread by the fabric spreading machines the adjustment can be made quickly by simply loosening the set screws which lock the position of the slide blocks on the auxiliary track and then sliding the rail to a new position relative to the table, in which the cam block is in the proper position. The set screws on the slide blocks are then tightened and the fabric spreading machine is again ready for operation. This eliminates a need for time consuming removal of the brackets which hold the rail in place on conventional fabric spreading machines and the reinstallation of these brackets followed by final adjustment of the cam block in order to set the cam block at the proper position relative to the table.

Additional objects and advantages of the invention will become apparent during the course of the following specification when taken in connection with the accompanying drawings in which:

BRIEF DESCRIPTION OF THE DRAWINGS

FIG. 2 is a fragmentary side elevation view of the machine table of FIG. 1, showing the adjustable motion control apparatus of the present invention;

FIG. 3 is an enlarged cross-sectional view taken along the line 3—3 of FIG. 2;

FIG. 4 is a framentary side elevation view similar to FIG. 2 showing the motion control apparatus of a conventional fabric spreading machine;

FIG. 5 is an enlarged cross-sectional view taken along the line 5—5 of FIG. 4.

DESCRIPTION OF THE PREFERRED EMBODIMENT

Figure 1:
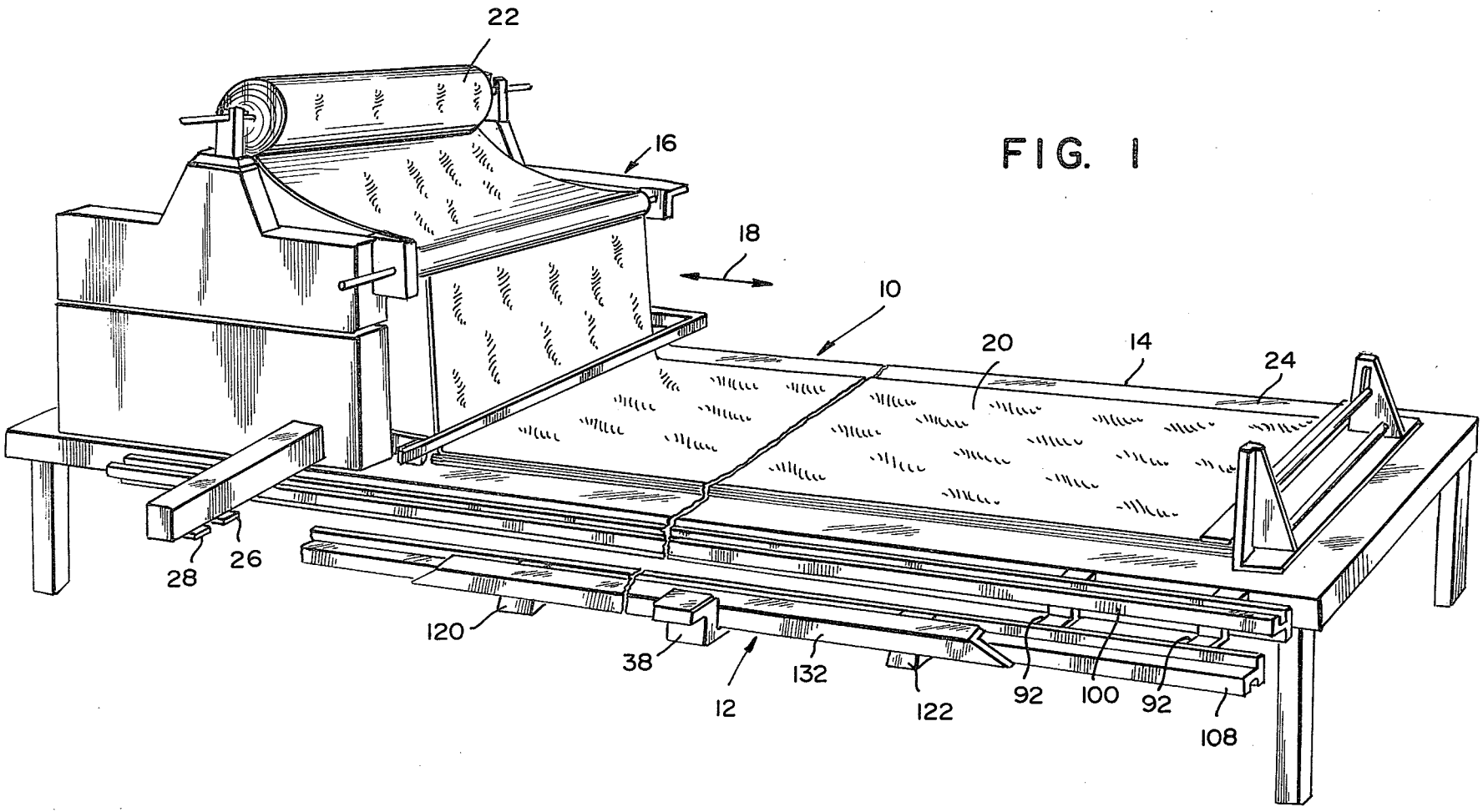
FIG. 1 is a perspective view of a fabric spreading machine assembly including a carriage movable along the surface of a table upon which there is mounted an adjustable motion control apparatus made in accordance with the present invention.

Referring in detail to the drawings, there is shown in FIG. 1 a fabric spreading machine 10 on which there is mounted an adjustable motion control apparatus 12 made in accordance with the present invention. The fabric spreading machine 10 is conventional in nature and will be described in general terms for purposes of reference. The fabric spreading machine 10 comprises a table 14 upon which is mounted a removable carriage assembly 16. The carriage assembly 16 traverses the table 14 in the directions shown by the arrow 18 in FIG. 1 in order to deposit layers of fabric 10 or film material from a supply roller 22 onto the surface 24 of the table 14. The motion of the carriage assembly 16 is controlled by a pair of switches 26, 28 which are mounted on the carriage assembly. Actuation of the first switch 26 causes a reduction in the traverse speed of the carriage assembly 16 and actuation of the second switch 28 causes the carriage assembly 16 to reverse direction thereby spreading an additional layer of fabric.

In order to facilitate the description of the adjustable motion control apparatus 12, according to the present invention, the conventional motion control apparatus 30 which is shown in FIGS. 4 and 5 will first be described for purposes of comparison.

As is best shown in FIG. 4, in a conventional motion control apparatus 30, the first switch 26 makes contact with a cam surface 32 which is formed on the end 34 of a rail 36 of inverted L-shape cross-section. Shortly thereafter, the second switch 28 makes contact with a cam block 38 which is mounted on the rail 36 by means of a pair of set screws 40, 42.

The rail 36 is attached to the edge 44 of the table 14 by means of a pair of brackets 46, 48. The rail 36 is attached to the brackets 46, 48 by means of screws 50, 52, 54, 56, 58, 60 and the brackets 46, 48 are attached to the table 14 by means of screws 62, 64, 66, 68, 70, 72.

Also attached to the same edge 44 of the table 14 is a track 78 of channel shape which extends the length of said table and which guides the carriage assembly 16 in its movement back and forth along the table. The track 78 has parallel upstanding legs 88 and 90 forming a channel 86 in which roll the wheels (not shown) of the carriage assembly 16. The track 78 extends parallel to the edge of table 14 and is spaced from said edge by a plurality of spacers 74. Screws 76 extend through a depending leg portion of track 78 and through the spacers 74 to mount the track along the edge of table 14, as shown in FIG. 5.

The brackets 46 and 48 are attached to the table 14 at intermediate locations between the spacers 74 and screws 76. When the fabric spreading machine 10 requires adjustment to alter the length of the fabric being spread, the screws 62, 64, 66, 68, 70 and 72 holding the brackets 46, 48 must be removed and the rail 36 moved to a new location and remounted on the table 14. Since the brackets 46, 48 can be located only at fixed intervals along the table 14, and since to be mounted they must be clear of the spacers 74, it often becomes necessary to change the position of the cam block 38 upon the rail 36 in order to locate the cam block in the exact position required for reversal of the carriage movement. Thus, after the rail 36 is repositioned and remounted, it is then necessary to loosen the screws 40 and 42, slide the cam block 38 to an exact adjusted position on rail 36, and to retighten screws 40, 42. This procedure is both tedious and time consuming.

As is best shown in FIG. 5, the rail 36 comprises a horizontal leg 80 and a vertical leg 82. The vertical leg 82 rides in a slot 84 formed in the brackets 46, 48 and is held in place by the screws 50, 52, 54, 56, 58, 60 which are shown in FIG. 4.

The adjustable motion control apparatus 12 according to the present invention is shown in detail in FIGS. 1, 2, 3 and 6 and comprises a plurality of brackets 92 each having an upper leg 94 which is mounted on the edge 44 of the table 14 by means of a screw 96 which passes through the vertical leg 98 of a guide track 100 and the spacer 102. The guide track 100 is identical to the guide track 78 in FIGS. 4 and 5 and serves to guide the carriage assembly 16 of FIG. 1. The guide track 100 comprises a pair of vertical legs 98, 104 and a horizontal portion 106 which joins the leg 104 to an intermediate position of the leg 98. An auxiliary track 108 is mounted on a lower leg 110 of the bracket 92 by means of a plurality of screws, one of which is designated by the reference number 112 in FIG. 3. The auxiliary track 108 is identical in configuration to the first track 100, thereby resulting in an economy of manufacture. However, the auxiliary track 108 is mounted in an inverted position relative to the guide track 100. The auxiliary track 108 comprises vertical legs 114, 116 and a horizontal portion 118.

A pair of identical slide blocks 120, 122 are mounted on the auxiliary track 108, one of which blocks is shown in FIG. 3. This slide block 122 is a unitary member having a horizontal groove 124 which accepts the horizontal portion 118 of the auxiliary track 108, and a vertical groove 126 which accepts the vertical leg 114 of the auxiliary track 108. The sliding block 122 is thus held captive on the auxiliary track 108, yet is free to slide along the track. The position of the sliding blocks 120, 122 along the track may be locked by means of respective set screws 128, 130, the top ends of which bear against the lower surface of the horizontal portion 118 of the auxiliary track 108.

A rail 132, which is substantially identical to the rail 36 in FIG. 4, is attached to the sliding blocks 120, 122 by means of screws 134, 136. The ends 138, 140 of the rail 132 have inclined cam surfaces 142, 144 which serve to actuate the first switch 26 on the carriage assembly 16, causing the carriage assembly 16 to slow down.

Figure 6:
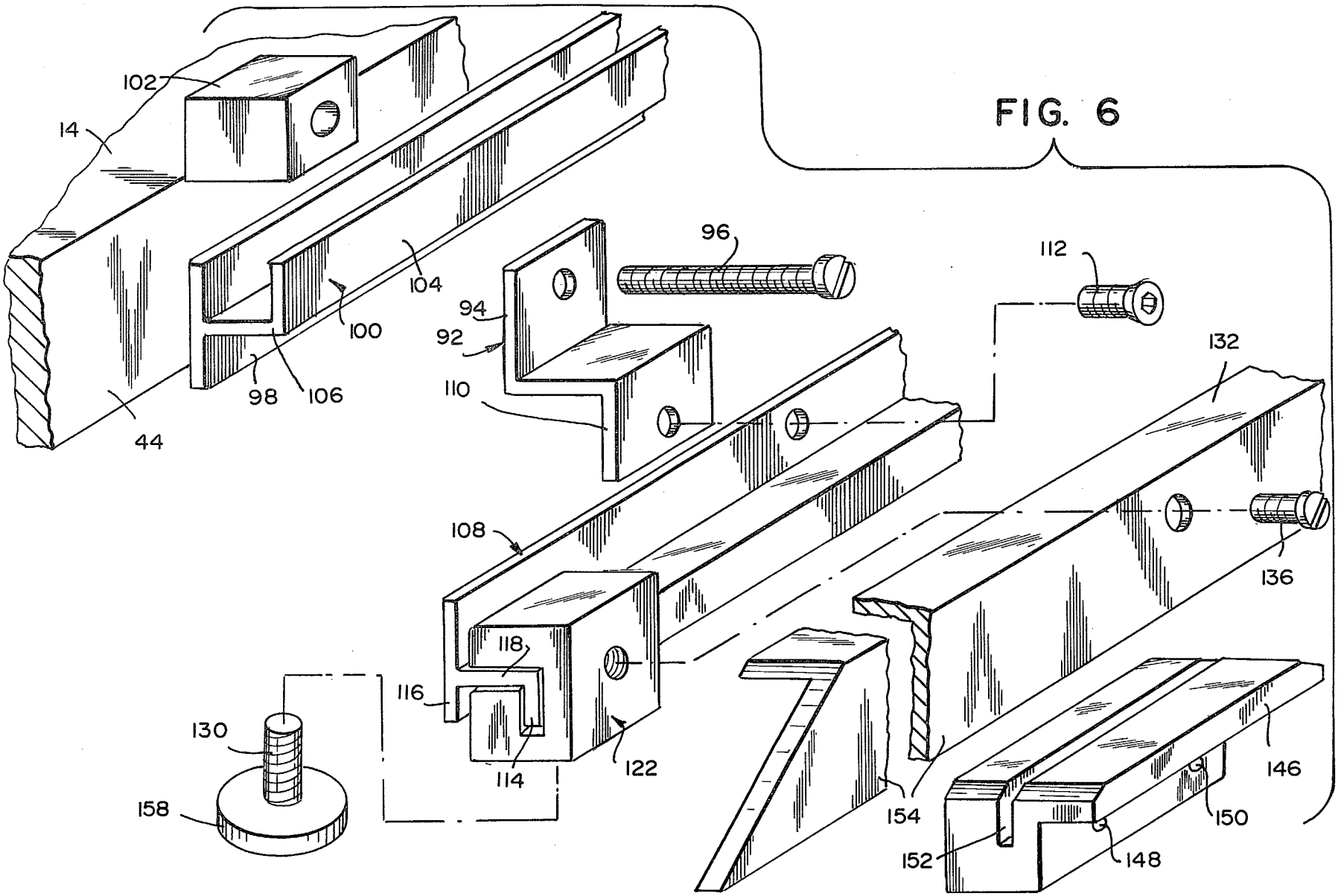
FIG. 6 is an exploded view of the adjustable motion control apparatus of FIG. 1.

A cam block 146 is mounted on the rail 132 by means of set screws 148, 150. The cam block 146 is substantially identical to the cam block 38 shown in FIG. 4 and includes a slotted portion 152 which accepts the vertical portion 154 of the rail 132 as is best shown in FIG. 6. The cam block 146 serves to actuate the second switch 28 of the carriage assembly 16, thereby causing the carriage assembly 16 to reverse direction.

When it is desired to adjust the length of the fabric being deposited on the table 14 by the carriage assembly 16, all that is necessary for an operator to do is to loosen the two set screws 128, 130 on the slide blocks 120, 122 using the knurled knobs 156, 158, slide the rail 132 along the auxiliary track 108 to the proper position, and retighten the set screws 128, 130. This procedure can be accomplished quickly and accurately without a need for tools or a need to reposition the cam block 146 in order to achieve the desired accuracy of position.

While a preferred embodiment of the invention has been shown and described herein, it is obvious that numerous omissions, changes and additions may be made in such embodiment without departing from the spirit and scope of the invention.

What is claimed is:

1. An adjustable motion control apparatus for a fabric spreading machine assembly which includes a table and a carriage which is driven back and forth along said table to deposit layers of fabric upon the surface of said table and is guided by a guide track extending along one longitudinal edge of said table, said carriage mounting a first switch which slows the motion of said carriage and a second switch which reverses the direction of motion of the carriage, said adjustable motion control apparatus comprising:

an auxiliary track sized to extend along substantially the entire length of said table, track mounting means securing said auxiliary track means to said table with said auxiliary track extending parallel to said guide track and being spaced therefrom, an elongated rail member positioned to engage and actuate said first switch, rail mounting means for adjustably mounting said rail member on said second track means for movement to selected positions thereon, locking means for locking said rail member to said second track means, and cam block means adjustably mounted on said rail means for actuation of said second switch.

2. An apparatus according to claim 1 in which said rail mounting means is slidably mounted on said auxiliary track.

3. An apparatus according to claim 1 in which said auxiliary track has a cross-sectional configuration identical to that of said guide track.

4. An apparatus according to claim 1 in which said rail mounting means comprises a pair of slide blocks, each slidably mounted on said track means, said slide blocks being attached, one each, proximate to opposite ends of said elongated rail member.

5. An apparatus according to claim 4 in which said locking means comprises a set screw mounted in each of said slide blocks and capable of bearing against said auxiliary track, thereby locking the relative position of said rail member and said auxiliary track.

6. An apparatus according to claim 4 in which said auxiliary track comprises a pair of spaced apart vertical portions and a horizontal portion connecting said vertical portions.

7. An apparatus according to claim 6 in which said slide blocks each have a portion slidably disposed between said vertical portions of said auxiliary track and portions disposed above and below said horizontal portion of said auxiliary track.

8. An apparatus according to claim 7 in which said portions of said slide blocks disposed below said horizontal portion of said second track means, each have a set screw capable of bearing against said auxiliary track.

9. An apparatus according to claim 1 in which said track mounting means comprises a plurality of brackets attaching said auxiliary track to an edge of said table.

10. An apparatus according to claim 9 in which said plurality of brackets are attached to said table by means of plurality of screws each passing through said guide track.

* * * * *